US006345978B1

(12) United States Patent
Lu

(10) Patent No.: US 6,345,978 B1
(45) Date of Patent: Feb. 12, 2002

(54) TORCH

(75) Inventor: James Lu, Roswell, GA (US)

(73) Assignee: International Business Corporation, Alpharetta, GA (US)

( * ) Notice: Subject to any disclaimer, the term of this patent is extended or adjusted under 35 U.S.C. 154(b) by 0 days.

(21) Appl. No.: 09/596,872

(22) Filed: Jun. 19, 2000

(51) Int. Cl.[7] ..... F23Q 25/00

(52) U.S. Cl. ..... 431/152; 431/324; 431/343; 431/33

(58) Field of Search ..... 431/152, 146, 431/144, 320, 310, 33, 35, 34, 343, 344, 324; 362/415, 431, 806

(56) References Cited

U.S. PATENT DOCUMENTS 1,134,314 A * 4/1915 Canchester ..... 431/146
3,066,515 A * 12/1962 Virtanen ..... 431/152
3,316,957 A * 5/1967 Stockli et al. ..... 431/152
4,477,247 A * 10/1984 Kumasaka ..... 431/320
4,810,185 A * 3/1989 Nakamura et al. ..... 431/146
5,807,093 A * 9/1998 Tendick, Sr. ..... 431/320

FOREIGN PATENT DOCUMENTS

GB 628897 * 9/1949 ..... 431/152
JP 56-20930 A * 2/1981 ..... 431/152

* cited by examiner

*Primary Examiner*—Ira S. Lazarus
*Assistant Examiner*—Josiah C. Cocks
(74) *Attorney, Agent, or Firm*—Rodgers & Rodgers

(57) ABSTRACT

A torch comprising a frame structure with a fuel container disposed therein, a flame guard cap extending upwardly from the frame with an aperture formed therein, a wick disposed in the aperture, and a rotatable snuffer cap attached to the frame and adapted to cover the wick.

4 Claims, 1 Drawing Sheet

TORCH

BACKGROUND OF THE INVENTION

Outdoor entertaining during the evening hours has become quite popular. One method of providing lighting while at the same time creating an atmosphere of conviviality is to utilize open flame torches.

Traditionally, torches have included the basic fuel container, wick and snuffer cap. Typically, the snuffer cap is attached to the fuel container or frame therefor by such means as a chain or wire. Of course, in order to extinguish the flame, this type of snuffer cap must be grasped by using tongs, a towel and the like. Since the flame and surrounding metal parts are quite hot, this means of extinguishing the flame is quite cumbersome and somewhat dangerous.

SUMMARY OF THE INVENTION

A torch comprising a frame with a fuel container disposed therein, a flame guard cap extending upwardly from the fuel container and having an aperture formed therein, a wick disposed in the aperture, a snuffer cap rotatably mounted on the flame and adapted to selectively cover the wick.

DESCRIPTION OF THE PREFERRED EMBODIMENT

Figure 1:
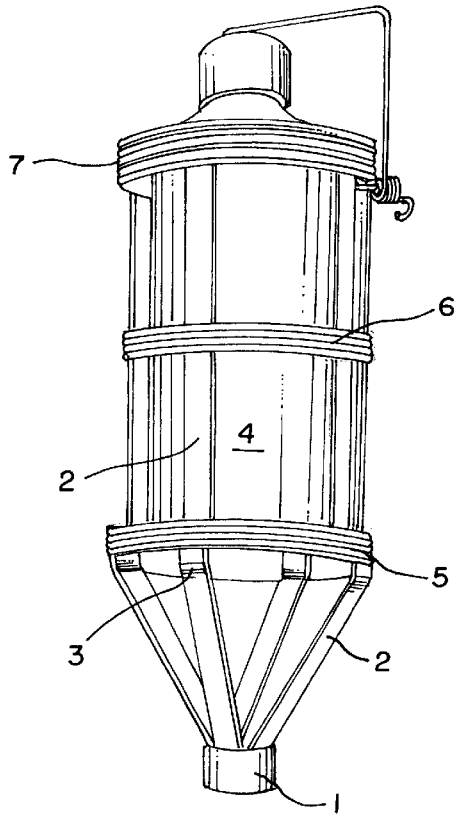
FIG. 1 is a perspective view of a torch according to this invention.

In the drawings and with particular attention to FIG. 1, the numeral 1 designates the torch base with multiple struts 2 extending upwardly therefrom to form a frame. Struts 2 are bent so as to provide edges 3 upon which fuel container 4 is positioned. Extending upwardly from edges 3, struts 2 are coextensive with fuel container 4 and are held in place by means of multiple rims 5, 6 and 7. More specifically, lower rim 5, intermediate rim 6 and upper rim 7 are provided, the inner surfaces of which are attached to the outer surfaces of struts 2 by any suitable means such as welding.

Attached to the upper edge of upper rim 7 is flame guard 8 with aperture formed therein. Wick 10 is positioned in aperture 9 and extends into fuel container 4 as is well known in the art. Of course, fuel container 4 is filled with ordinary lamp oil or any other suitable fuel.

According to this invention, snuffer cap 11 is provided and is attached to lever arm 12 which is bent at approximately its midpoint to form a 90 degree angle. Formed on the end of lever arm 12 opposite from snuffer cap 11 is helical element 13 and lever 14. Attachment bar 15 extends through helical element 13 with the ends thereof attached to upper rim 7, as best shown in FIG. 3.

Figure 2:
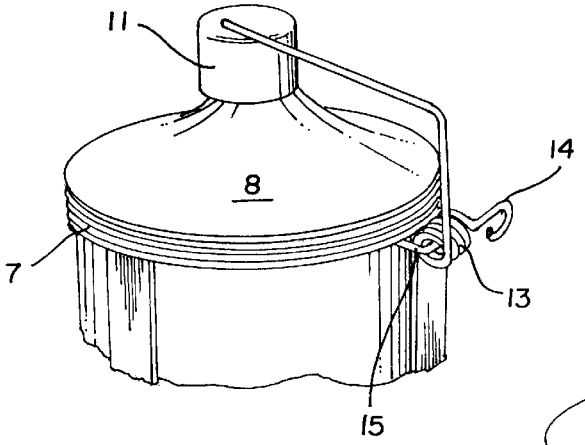
FIG. 2 is an enlarged perspective view of the upper portion of the torch with the snuffer cap in the closed position.
Figure 3:
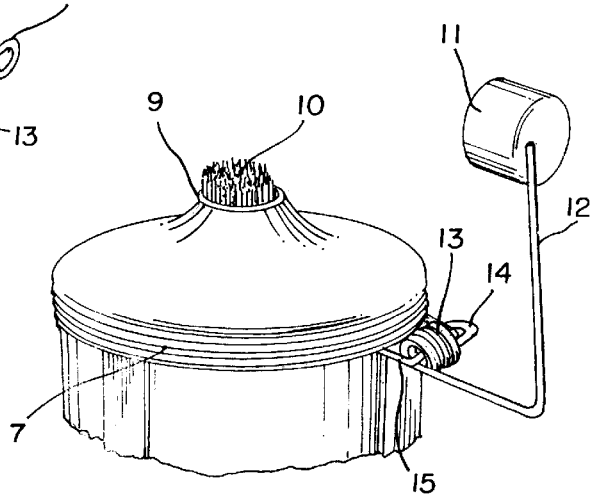
FIG. 3 is an enlarged perspective view of the upper portion of the torch with the snuffer cap in the open position.

In operation, with the torch as shown in FIG. 3, wick 10 is simply lighted in the normal fashion. When it is desired to extinguish the flame, lever 14 is simply turned manually thereby causing lever arm 12 and associated snuffer cap 11 to rotate from the position shown in FIG. 3 to the position shown in FIG. 2 such that snuffer cap 11 covers wick 10. This action reduces the supply of oxygen to wick 10 and extinguishes the flame.

Therefore, by this invention, a torch is used essentially for entertainment purposes and allows the user to light the torch and then easily and conveniently extinguish the flame. Since lever 14 is spaced from the flame, it is always cool to the touch thereby preventing any possible injury.

What is claimed is:

1. A torch comprising a base, multiple struts upstanding therefrom, edges formed in said struts, a fuel container disposed on said edges, said struts comprising outer surfaces and at least one rim secured to the outer surfaces of said struts, a snuffer cap, a rotatable lever arm attached to said snuffer cap at one end thereof and to one of said struts at the other end thereof, and said lever arm at said other end comprising a combination helical element and lever arm.

2. A torch according to claim 1 wherein a flame guard cap is attached to the upper edge of said rim and an aperture is formed in said flame guard cap.

3. A torch according to claim 2 wherein a wick is disposed in said aperture and said snuffer cap is adapted to cover said wick.

4. A torch according to claim 1 wherein said helical element is attached to said one strut by means of an attachment bar.

* * * * *